US006213743B1

(12) United States Patent
Kohsokabe et al.

(10) Patent No.: US 6,213,743 B1
(45) Date of Patent: Apr. 10, 2001

(54) DISPLACEMENT TYPE FLUID MACHINE

(75) Inventors: Hirokatsu Kohsokabe, Ibaraki-ken; Masahiro Takebayashi, Tochigi-ken; Shunichi Mitsuya, Shizuoka-ken; Hiroaki Hata; Yasuhiro Ohshima, both of Tochigi-ken; Kenji Tojo, Ibaraki-ken, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/272,356

(22) Filed: Mar. 19, 1999

(30) Foreign Application Priority Data

Mar. 19, 1998 (JP) ..... 10-069782

(51) Int. Cl.[7] ..... F04C 18/00
(52) U.S. Cl. ..... 418/61.1; 418/178; 418/179
(58) Field of Search ..... 418/61.1, 178, 418/179

(56) References Cited

FOREIGN PATENT DOCUMENTS 55-023353 * 2/1980 (JP) ..... 418/61.1
55112892 * 9/1990 (JP) ..... 418/61.1
05202869 * 8/1993 (JP) ..... 418/61.1
09268987 * 10/1997 (JP) ..... 418/61.1

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

A conventional displacement type fluid machine is featured by a low sliding rate and in low vibrations and pulsations, but has a problem, that the radial gap in a displacer sliding portion is enlarged by the clearance of a shaft drive system and a rotating moment acting on a displacer so that the internal leakage of a working fluid is increased to lower the performance and the reliability. To eliminate this problem, the sliding contact portion between a cylinder 4 and a displacer 5 is made into a predetermined section, and the cylinder and the displacer are so contoured that when they are made concentric, the normal distance in the sliding contact section between the cylinder contour and the displacer contour may be smaller than that of the remaining section, thereby to decrease the radial gap to lower the internal leakage of the working fluid and to improve the performance and the reliability.

5 Claims, 10 Drawing Sheets

DISPLACEMENT TYPE FLUID MACHINE

BACKGROUND OF THE INVENTION

The present invention relates to a displacement type fluid machine, such as a pump, a compressor or an expander.

The gyration type displacement type fluid machine of this kind (referred to hereinafter simply as a "gyration type fluid machine") has been proposed in Unexamined Japanese Patent Publication No. 55-23353 (Publication 1), U.S. Pat. No. 2,112,890 (Publication 2), Unexamined Japanese Patent Publication No. 5-202869 (Publication 3) and Unexamined Japanese Patent Publication No. 6-280758 (Publication 4).

The gyration type fluid machine, as disclosed in any of Publications 1 to 4, has essentially advantageous features as a displacement type fluid machine in that it has multiple cylinders and a completely balanced rotating shaft, so that it produces lower in pressure pulsations and vibrations and a lower relative sliding rate between a displacer and a cylinder, thereby to reduce the frictional loss.

However, the stroke of the individual working chambers, to be formed by a plurality of vanes including a displacer and a cylinder, from the completion of the suction to the completion of the discharge is as short (e.g., about one half of the rotary type and equal to that of the reciprocating type) as about 180 degrees in terms of a shaft rotation angle θ, so that the flow velocity in the discharge process is so high as to increase the over compression loss, thereby to cause a problem of reduction in performance. In the fluid machine of this type, on the other hand, a rotating moment to rotate the displacer itself acts as a reaction from the compressed working fluid upon the displacer so that the moment is applied to the contact point between the cylinder and the displacer. In the structure disclosed in any of Publications 1 to 4, however, the working chambers from the completion of the suction, to the completion of the discharge are concentrated on one side of the drive shaft. As a result, the rotating moment acting on the displacer grows excessive thereby to invite a defect in that the performance and reliability are degraded by the wear on the vanes. Unexamined Japanese Patent Publication No. 9-268987 (Publication 5) has proposed a displacement type fluid machine as a gyration type fluid machine to solve that defect.

Now, in order to achieve a high efficiency in a displacement type fluid machine in which one space is formed by the inner wall face of a cylinder and the outer wall face of a displacer when the center of the displacer is located at the center of rotation of a rotating shaft, and in which a plurality of spaces are formed when a positional relationship between the displacer and the cylinder is located at the position of gyration, it is necessary to lower the fluid friction loss and the mechanical friction loss and to minimize the internal leakage of the working fluid which will occur through the gap (i.e., the radial gap) of the sliding portion between the displacer and the cylinder forming the working spaces (or working chambers).

In the a conventional machine in which the cylinder and the displacer are so contoured that a gap of a predetermined width (or a gyration radius) is formed between the cylinder and the displacer when they are made concentric, however, the radial gap is enlarged by the clearance of the shaft drive system for moving the displacer and by the rotating moment acting upon the displacer to increase the internal leakage of the working fluid thereby to cause a problem that the machine performance is lowered.

When the eccentricity of the drive shaft is increased to enlarge the gyrating radius of the displacer so as to reduce that radial gap, on the other hand, the displacer contacts the outer peripheral portion of its contour with the cylinder so that a seriously excessive load (or the reaction of the contact portion) acts upon the drive shaft because of the small contact angle leading to a problem of reduction in reliability, such as seizure of the shaft.

SUMMARY OF THE INVENTION

An object of the invention is to provide a displacement type fluid machine in which one space is formed by the inner wall face of a cylinder and the outer wall face of a displacer when the center of the displacer is located at the center of rotation of a rotating shaft, and in which a plurality of spaces are formed when a positional relationship between the displacer and the cylinder is located at the position of gyration, wherein the load on the drive shaft is reduced while also reducing the internal leakage of the working fluid.

The above-specified object is achieved by providing a displacement type fluid machine in which one space is formed by the inner wall face of a cylinder and the outer wall face of a displacer when the center of said displacer is located at the center of rotation of a rotating shaft, and in which a plurality of spaces are formed when a positional relationship between said displacer and said cylinder is located at the position of gyration, wherein when the center of said displacer is located at the center of rotation of said rotating shaft, the gap between the inner wall face of said cylinder and the outer wall face of said displacer is different depending upon the position.

On the other hand, the aforementioned object is achieved by providing a displacement type fluid machine in which one space is formed by the inner wall face of a cylinder and the outer wall face of a displacer when the center of said displacer is located at the center of rotation of a rotating shaft, and in which a plurality of spaces are formed when a positional relationship between said displacer and said cylinder is located at the position of gyration, wherein when the center of said displacer is located at the center of rotation of said rotating shaft, the gap between the inner wall face of said cylinder and the outer wall face of said displacer is made alternately wide and narrow.

On the other hand, the aforementioned object is achieved by providing a displacement type fluid machine in which one space is formed by the inner wall face of a cylinder and the outer wall face of a displacer when the center of said displacer is located at the center of rotation of a rotating shaft, and in which a plurality of spaces are formed when a positional relationship between said displacer and said cylinder is located at the position of gyration, wherein when the center of said displacer is located at the center of rotation of said rotating shaft, the gap between the inner wall face of said cylinder and the outer wall face of said displacer is made narrow at the portion having a large curvature of the outer wall curve of said displacer.

Moreover, the aforementioned object is achieved by providing a displacement type fluid machine in which a displacer and a cylinder are arranged between end plates, in which one space is formed by the inner wall face of said cylinder and the outer wall face of said displacer when the center of said displacer is located at the center of rotation of a rotating shaft, and in which a plurality of spaces are formed when a positional relationship between said displacer and said cylinder is located at the position of gyration, wherein said displacer is caused by a rotating moment in a fixed direction to slide into contact with said cylinder in a predetermined section, and wherein said cylinder and said displacer are so contoured that the distance in the sliding contact section between the inner wall face of said cylinder and the outer wall face of said displacer is smaller than that of the remaining sections when the center of said displacer is located at the center of rotation of a rotating shaft.

As a result, the play of the displacer itself in the rotational direction with the cylinder and the displacer meshing with each other is reduced to solve the problem that the radial gap is enlarged by the clearance of the shaft drive system and by the rotating moment acting upon the displacer. At the same time, no contact prevails except for the sliding contact section receiving the rotating moment acting upon the displacer, thereby to eliminate the problem that the reliability is lowered by the excessive load acting upon the drive shaft. Thus, it is possible to provide a gyration type fluid machine which can hold the radial clearance between the cylinder and the displacer at an optimum value and can improve the performance and the reliability of the machine.

DETAILED DESCRIPTION OF THE INVENTION

Figure 1:
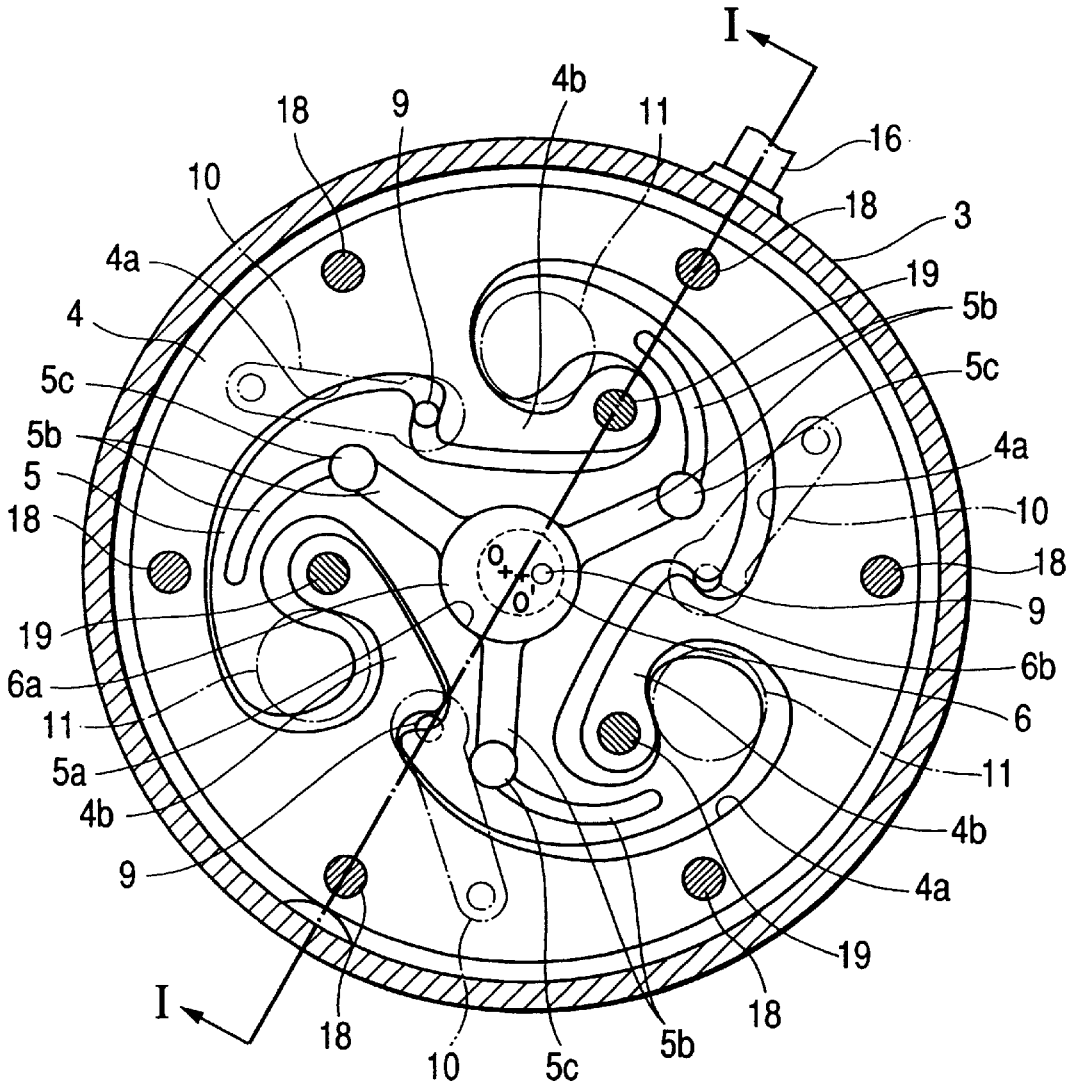
FIG. 1 is a transverse section (corresponding to section II—II of FIG. 2) of a hermetic type compressor in which a displacement type fluid machine according to one embodiment of the invention is applied to a compressor.
Figure 2:
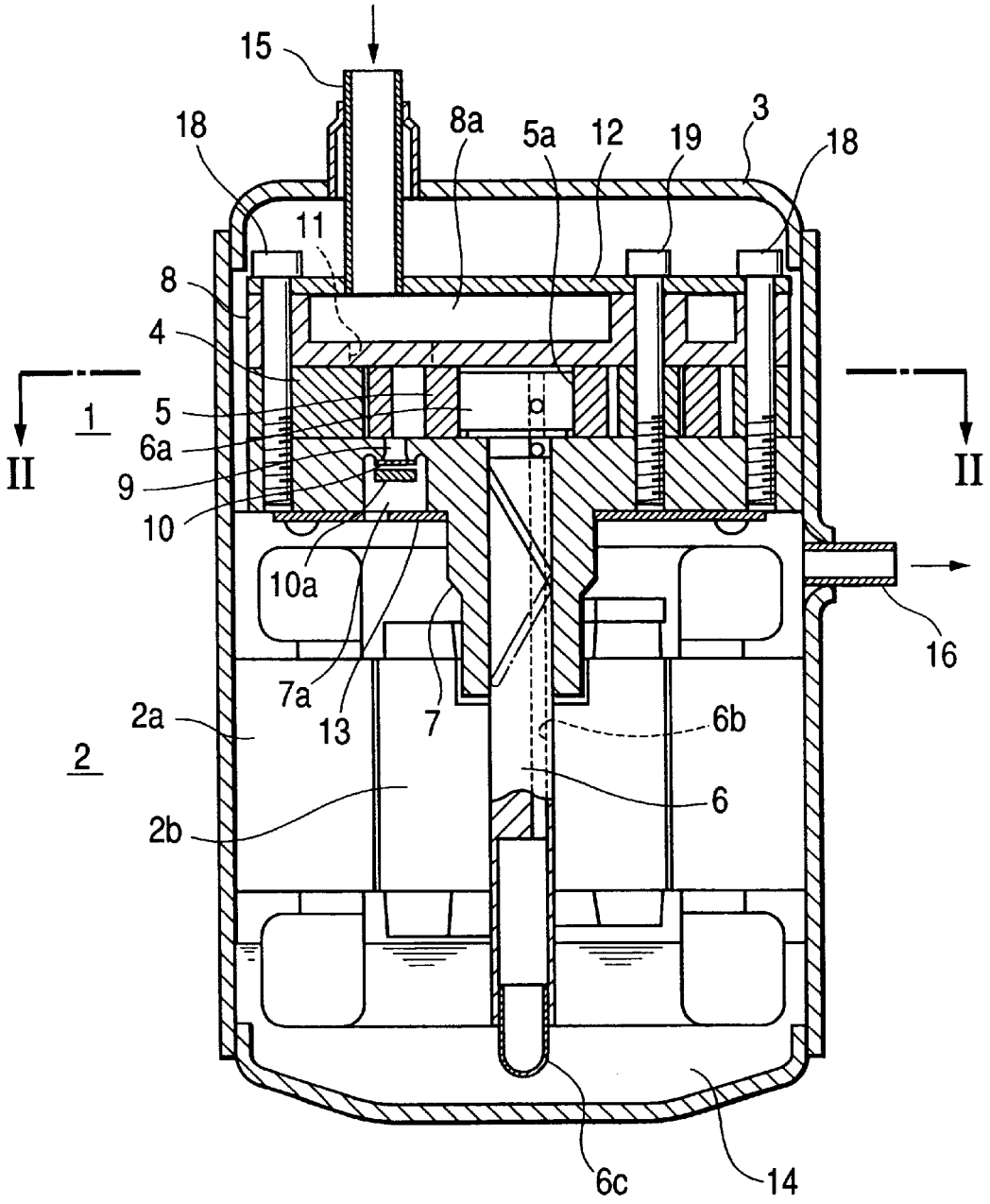
FIG. 2 is a longitudinal section taken along line I—I of FIG. 1.
Figure 3:
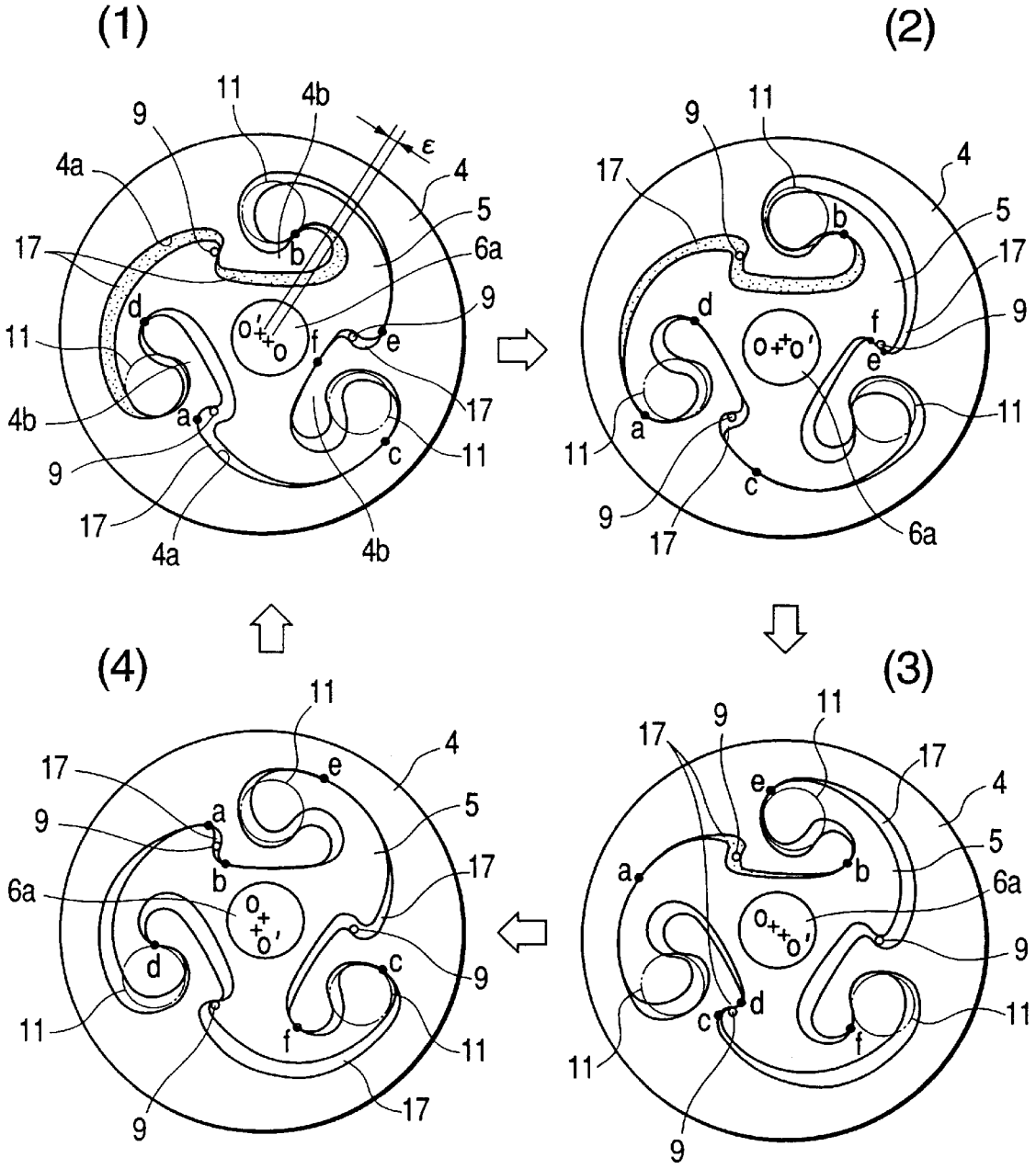
FIGS. 3(1) to 3(4) are presents diagrams for explaining the working principle of the displacement type fluid machine according to the invention.
Figure 4:
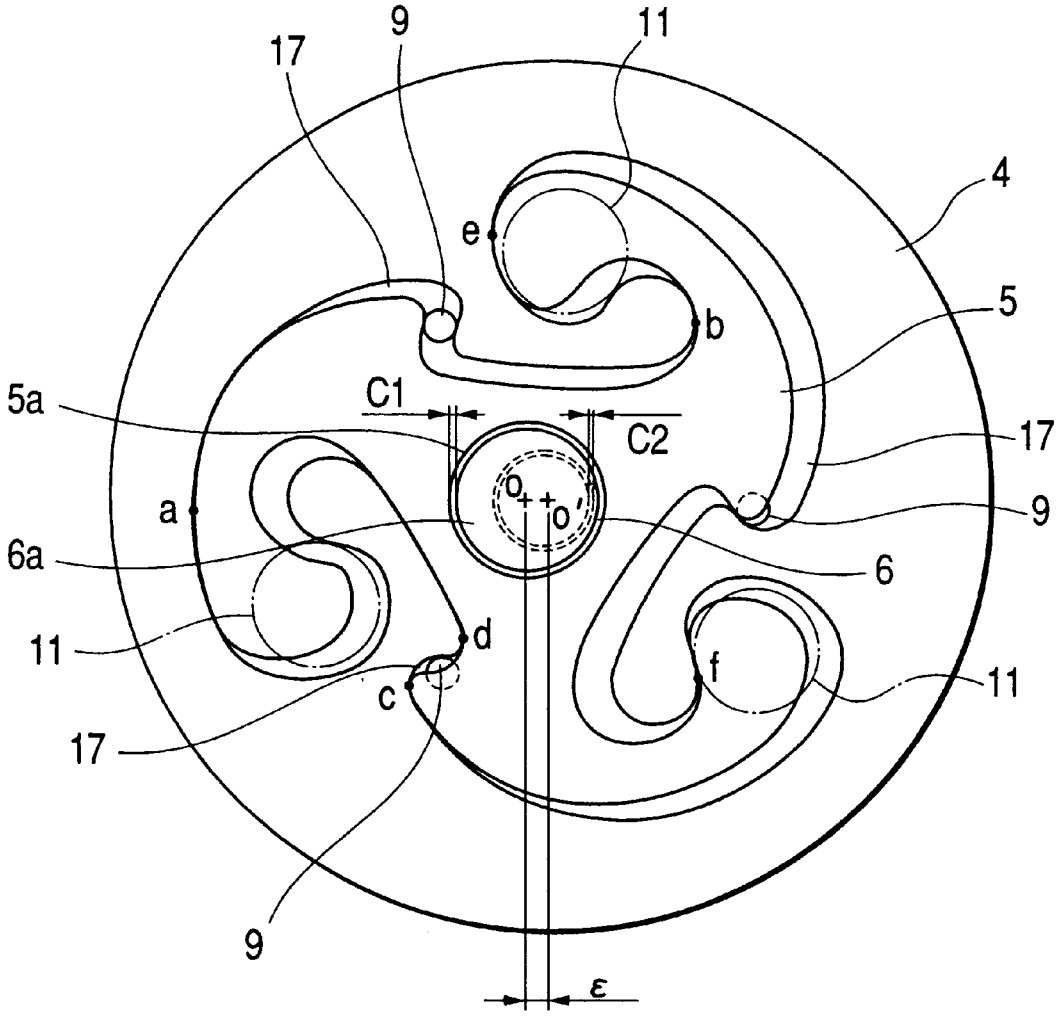
FIG. 4 is a top plan view of a cylinder and a displacer for illustrating the clearances of a shaft drive system of the displacement type fluid machine.
Figure 5:
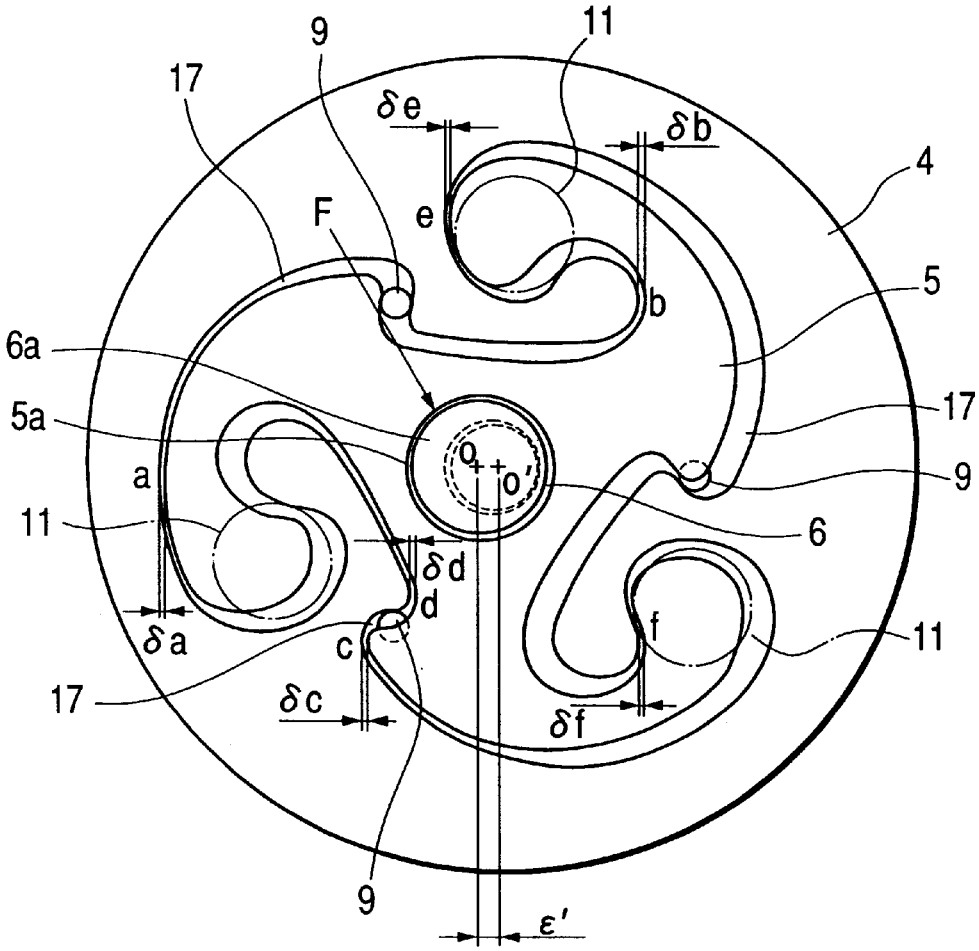
FIG. 5 is an explanatory diagram of radial gaps due to the clearances of the shaft drive system of the displacement type fluid machine.
Figure 6:
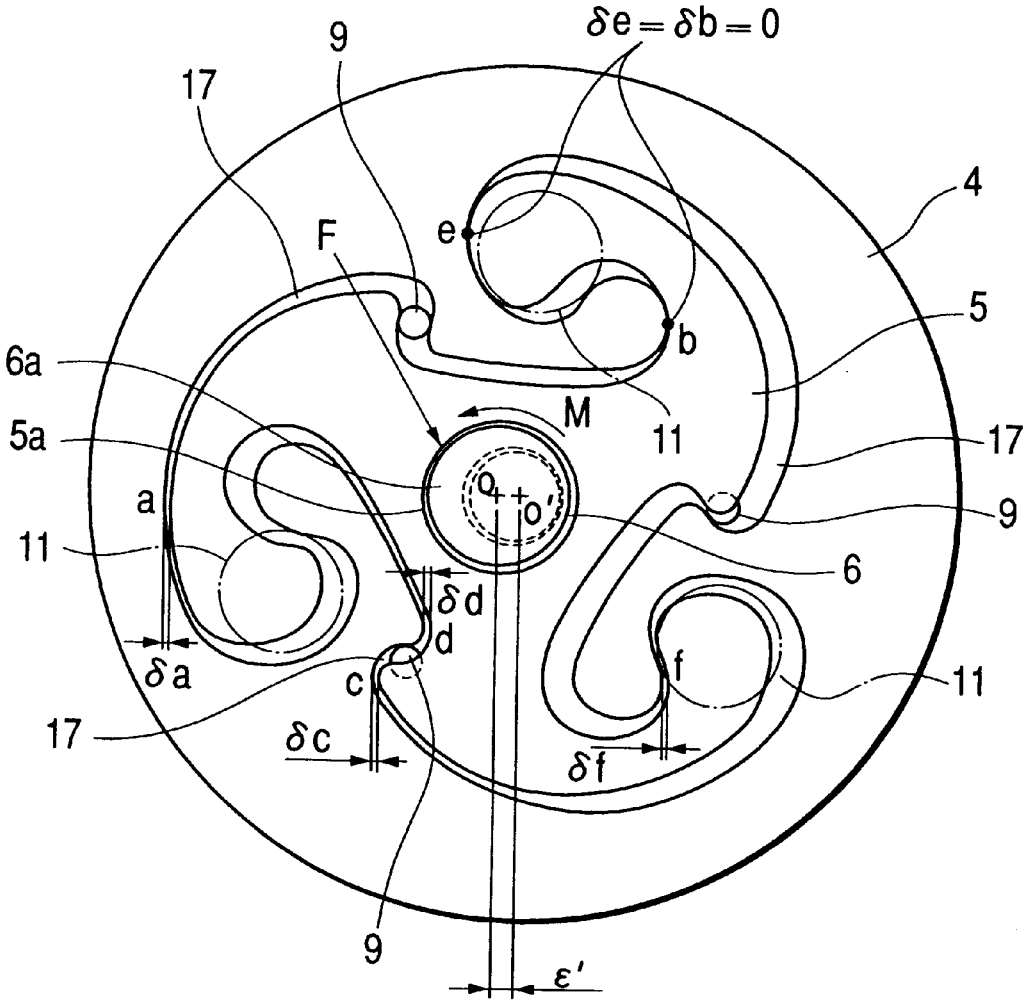
FIG. 6 is an explanatory diagram of the clearance of the shaft drive system of the displacement type fluid machine and the radial gap due to the rotating moment acting on the displacer.
Figure 7:
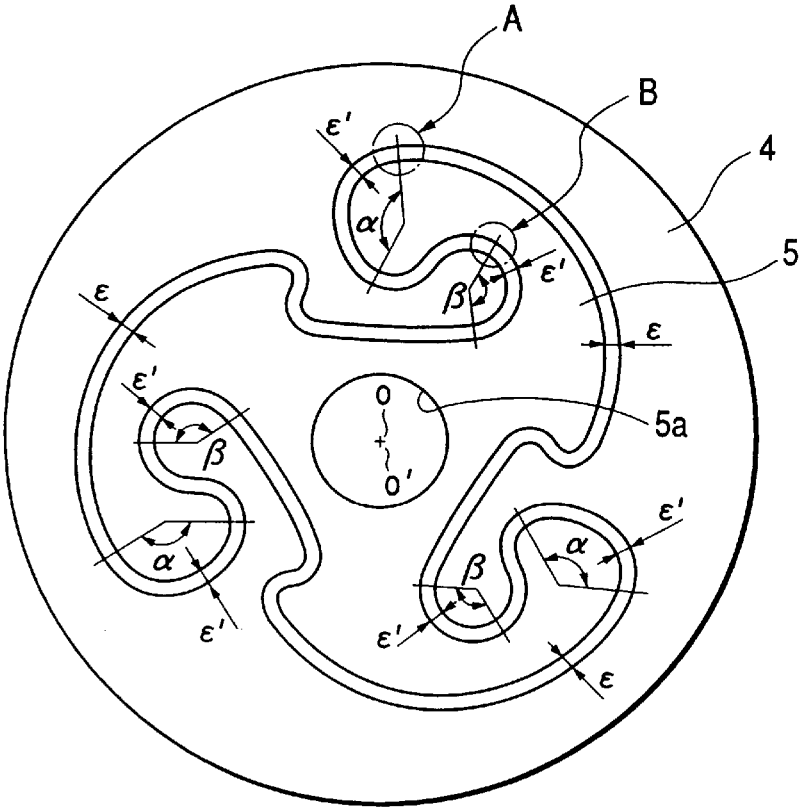
FIG. 7 is a top plan view of the cylinder and the displacer of a displacement type fluid machine according to the embodiment of the invention.
Figure 8A:
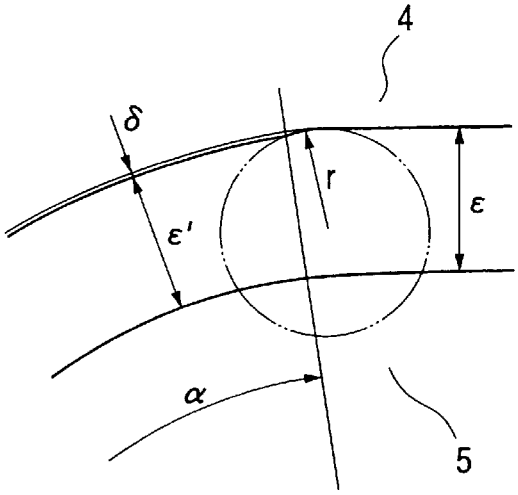
FIGS. 8(*a*) and 8(*b*) are enlarged views of essential portions (i.e., portion A and portion B) of FIG. 7.
Figure 8B:
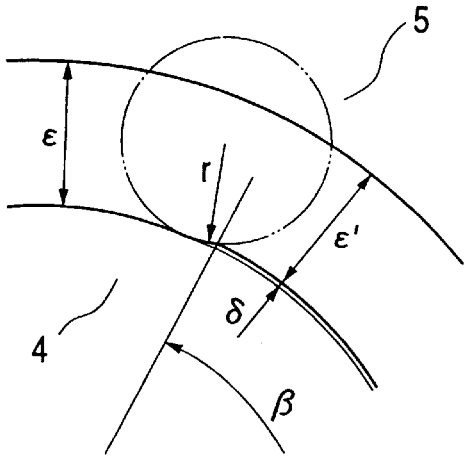

The features of the invention will be described in detail in connection with its embodiments and with reference to the accompanying drawings. The compression principle and soon are identical to those of the displacement type fluid machine, as disclosed in the foregoing Publication 5. FIG. 1 is a transverse section of a hermetic type compressor in which a displacement type fluid machine according to one embodiment of the invention is applied to a compressor; FIG. 2 is a longitudinal section take along line I—I of FIG. 1; FIG. 3 presents top plan views showing the working principle of an example in which the displacement type fluid machine of the invention is used as a compressor; FIGS. 4 to 6 are explanatory diagrams of the gap enlargement in the radial direction between a cylinder and a displacer produced by the rotating moment acting upon the clearances of the shaft drive system and the displacer; FIG. 7 is a top plan view for explaining the contours of the displacer and the cylinder according to the embodiment of the invention; an enlarged diagram of the portion A of FIG. 7 is shown in FIG. 8(*a*) and an enlarged diagram of the portion B (in FIG. 8(*b*).

FIG. 2, reference numeral shows a displacement type compression element according to the invention, a motor element 2 for driving the element 1, and a hermetic casing 3 housing the displacement type compression element 1 and the motor element 2. In FIG. 1, the displacement type compression element 1 is constructed to include: a cylinder 4 having a plurality of protrusions 4*b* (or also called "vanes") which protrude inward from an inner peripheral wall 4*a*, and fixing holes 19 for fixing the protrusions 4*b*; a displacer 5 (also called a "gyrating piston") arranged inside of the cylinder 4 and meshing with the inner peripheral wall 4*a* and the protrusions 4*b* of the cylinder 4; a drive shaft 6 having a crank portion 6*a* fitted in a bearing 5*a* at the central portion of the displacer 5 for driving the displacer 5; a main bearing 7 acting, as shown in FIG. 2, as an end plate for closing the lower end opening of the cylinder 4 and as a bearing for bearing the drive shaft 6; a cylinder head 8 acting as an end plate for closing the upper end opening of the cylinder 4; a discharge port 9 formed in the end plate of the main bearing 7; a reed valve type discharge valve 10 for opening/closing the discharge port 9, and a stopper (or a valve holder) 10*a*; and a suction port 11 formed in the cylinder head 8.

In FIG. 1, numeral 5*b* designates oil grooves formed in the two end faces of the displacer 5 and composed of a plurality of shallow grooves (having a depth of about 0.5 mm) curved and extended from the bearing 5*a* at the central portion to the vicinity of the outer peripheral end, and numeral 5*c* designates through holes providing communication between the two end faces of the displacer 5. In FIG. 2, numeral 12 designates a suction cover attached to the cylinder head 8 for forming a suction chamber 8*a* integrally with the cylinder head 8 to define the pressure (or a discharge pressure) in the hermetic casing 3. Numeral 13 designates a discharge cover for forming a discharge chamber 7*a* integrally with the main bearing 7. The motor element 2 is composed of a stator 2*a* and a rotor 2*b*, of which the rotor 2*b* is fixed by forcefit or shrinkfit on one end of the drive shaft 6. Numeral 14 designates lubricating oil which is reserved in the bottom portion of the hermetic casing 3 to soak the lower end portion of the drive shaft 6. Numeral 6*b* designates an oil feed hole for feeding the lubricating oil 14 to the individual sliding portions such as the bearings with centrifugal pumping action produced by the rotation of the drive shaft 6. An oil feed pipe 6*c* is connected to the shaft end of the drive shaft 6. Numeral 15 designates a suction pipe, and numeral 16 designates a discharge pipe. In FIGS. 3(1) to 3(4) numeral 17 designates working chambers which are defined by the engagements between the inner peripheral walls 4*a* and the protrusions 4*b* of the cylinder 4 and the displacer 5. In FIG. 2, on the other hand, numeral 18 designates assembling bolts of the compression element, and numeral 19 designates fixing bolts for preventing the protrusions 4*b* of the cylinder 4 from being deformed by the pressure.

The flow of the working gas will be described with reference to FIG. 2. The working gas having entered the suction chamber 8*a* formed in the cylinder head 8 via the suction pipe 15, as indicated by arrows, flows through the suction port 11 into the displacement type compression element 1, in which it is compressed (as will be detailed hereinafter) by the reduction in the volume of the working chamber, as caused when the displacer 5 is gyrated by the rotations of the drive shaft 6. The working gas thus compressed flows through the discharge port 9 formed in the end plate of the main bearing 7 into the discharge chamber 7*a* while raising the discharge valve 10 and further flows from the discharge cover 13 through the hermetic casing 3 and the discharge pipe 16 to the outside (while forming so-called "high-pressure chamber"). Next, the principle of operation of the displacement type compression element 1 will be described with reference to FIGS. 3(1) to 3(4). Reference letter o designates the center of the displacer 5. Reference letter o' designates the center of the cylinder 4 (or the drive shaft 6). Reference letters a, b, c, d, e and f designate engaging points (or seal points) where the inner peripheral wall 4*a* of the cylinder 4 and the vane 4*b* engage with the displacer 5. Here, the same combinations of curves are smoothly connected at three points so that the shape of the inner peripheral contour of the cylinder 4 is formed. Noting one combination, a curve forming the inner peripheral wall 4*a* and the vane 4*b* is composed of two curves: one inward convex vortex curve having an angle of substantially 360 degrees, and one inward concave vortex curve having an angle of substantially 360 degrees. These curves are arranged at a substantially equal pitch on a circumference around the center o', while the adjoining convex and concave curves are connected through smooth curves such as arcs to form an inner peripheral contour. The outer peripheral contour of the displacer 5 is also formed on the same principle as that of the cylinder 4. In the compression cycle, the drive shaft 6 is rotated clockwise so that the displacer 5 is not rotated around the center o' of the fixed cylinder 4, but is orbited by a gyrating radius $\epsilon(=oo')$. A plurality of working chambers 17 are formed around the center o of the displacer 5 (in this embodiment, three working chambers are always formed). An explanation will be given in connection with one working chamber defined by the engaging points a and b and hatched (although this working chamber is divided into two parts at the completion of the suction cycle, two parts of the working chamber immediately communicate with each other at the start of the compression cycle). FIG. 3(1) shows a state in which the working gas suction from the suction port 11 to this working chamber is completed. FIG. 3 (2) shows a state in which the drive shaft 6 (or the crank portion 6*a*) is rotated clockwise by 90 degrees from the state shown in FIG. 3(1). FIG. 3(3) shows a state in which the drive shaft 6 is further rotated by 180 degrees from the state shown in FIG. 3(1). After the drive shaft 6 shown in FIG. 3(3) is further rotated by 90 degrees to the state shown in FIG. 3(4), the drive shaft 6 returns to the first state shown in FIG. 3(1).

Thus, as the drive shaft 6 is rotated, the volume of the working chamber 17 is progressively reduced. Since the discharge port 9 is closed by the discharge valve 10 during this time, the working fluid is compressed. When the pressure in the working chamber 17 grows higher than an outer discharge pressure, the discharge valve 10 is automatically opened by the pressure difference, so that the compressed working gas is discharged through the discharge port 9. The shaft angle from the completion of the suction (the compression start) to the completion of the discharge is 360 degrees. A next suction process is prepared while each compression and discharge process is being carried out. A next compression process is started at the completion of the discharge. The working chambers for these sequential compressions are distributed and arranged at a substantially equal pitch around the drive bearing 5*a* located at the central portion of the displacer 5. Since the individual working chambers perform the compressions with a phase shift, the fluctuation in the output torque and the pressure pulsations of the discharge gas can be drastically reduced to decrease the resultant vibrations and noises. The description thus far made is substantially similar to that of the displacement type fluid machine, as disclosed in Publication 5.

Before the description of the invention, the problem of the radial gap between the cylinder and the displacer in the gyration type fluid machine will be explained with reference to FIGS. 4 to 6. Here, the cylinder and the displacer are contoured to form the gap E of a predetermined width between the cylinder and the displacer when they are aligned relative to each other. The eccentricity of the drive shaft will be considered for the same gap $\epsilon$.

FIG. 4 is an explanatory diagram showing the clearance of the shaft drive system; FIG. 5 is an explanatory diagram showing the radial gap due to the clearance of the shaft drive system; and FIG. 6 is an explanatory diagram showing the radial gap resulting from the rotating moment acting upon the clearance of the shaft drive system and the displacer.

In FIG. 4, letter C1 designates a bearing radial clearance of the crank portion 6*a*, and letter C2 designates a bearing radial clearance in the main bearing 7 of the drive shaft 6. Thus, a clearance never fails to exist in the shaft drive system for the rotary motions. Although a plain bearing is exemplified, the clearance also exists in the roller bearing. FIG. 4 shows a state in which such clearance of the shaft drive system exists, that is, an ideal state in which the drive shaft 6 is assembled concentrically without any eccentricity in the individual bearings. At this time, the gyrating radius $\epsilon(=oo')$ of the displacer 5 is equal to the eccentricity of the crank portion 6a of the drive shaft 6. On the other hand, the radial gaps of the individual working chambers 17 at the seal points a, b, c, d, e and f are zero. In the actual fluid machine, however, the fluid pressure due to the pressure in the working chambers acts upon the displacer so that the radial gap changes, as shown in FIGS. 5 and 6.

FIG. 5 shows the radial gap due to the clearance of the shaft drive system with no consideration given to the rotary displacement of the displacer itself. When a resultant force F (in the displacement type fluid machine, in which one space is formed by the inner wall face of the cylinder and the outer wall face of the displacer when the center of rotation of the rotating shaft is located at the center of the displacer, and in which a plurality of working spaces are formed when the positional relation between the displacer and the cylinder are located at a gyrating position, the resultant force F of the pressures in the individual working chambers never fails to act from the eccentric direction so that it acts to reduce the gyrating radius) due to the internal pressures of the individual working chambers 17 acts upon the displacer 5, the drive shaft 6 becomes eccentric in the individual bearings so that the gyrating radius of the displacer 5 becomes small, being reduced to $\epsilon'$ ($<\epsilon$).

As a result, the radial gaps at the seal points a, b, c, d, e and f of the individual working chambers 17 are extended the more for the smaller gyrating radius to $\delta a=\delta b=\delta c=\delta d=\delta e=\delta f$ ($=\epsilon-\epsilon'$)

On the other hand, FIG. 5 shows the case in which the angular displacement of the displacer itself is not considered. Considering the rotating moment M to rotate the displacer 5 by the resultant force F, however, the radial gap changes, as shown in FIG. 6. Specifically, the rotating moment M rotates the displacer 5 in a direction (counterclockwise) opposed to the gyrating direction (or clockwise) by the resultant force F. The radial gap at the seal points b and e receiving the rotating moment is $\delta b=\delta e=0$, but the radial gaps $\delta c$, $\delta d$ and $\delta f$ at the seal points c, d and f, as eccentric from the crank portion 6*a*, are enlarged to about two times as large as the gap $\delta$ a at the seal point a in the eccentric direction, thereby to raise a problem that the internal leakage of the working fluid from the higher pressure side to the lower pressure side increases to lower the performance.

For decreasing this internal leakage, it is necessary to reduce the radial gaps $\delta c$, $\delta d$ and $\delta f$. In order to reduce these radial gaps, the eccentricity of the drive shaft increases to enlarge the gyrating radius of the displacer. In this case, as apparent from FIG. 6, the displacer having a small radial gap comes into contact at the seal point a of its outer periphery of the contour with the cylinder. Since this portion has a small contact angle, an excessively high load (or the reaction of the contact portion) acts on the drive shaft to cause a problem leading to a reduction in the reliability such as the seizure of shaft. When the rotating moment M is received at a portion having a large radius of curvature, such as the contact point a of the displacer, a force to expand the gap between the drive shaft and the cylinder acts to apply an excessive load to the drive shaft by the wedge effect or the like, even if the rotating moment is low.

Against this problem, according to this embodiment, the contours of the cylinder and the displacer can be devised to set the optimum radial gap. FIG. 7 is a top plan view showing the contours of the cylinder and the displacer according to one embodiment of the invention, and an enlarged view of the portion A of FIG. 7 is provided while in FIG. 8(*a*) and an enlarged view of the portion B is provided while in FIG. 8 (*b*). FIG. 7 shows the center o' of the cylinder 4 overlapping with the center o of the displacer 5. In accordance with the invention, the gap between the cylinder 4 and the displacer 5 (i.e., the normal distance between the two contour curves of the cylinder and the displacer) is not constant, but is made alternately wider and narrower. At the portion having a smaller radius of curvature of the contour of the displacer, the load of the rotating moment on the drive shaft is lighter than at the portion having a larger radius of curvature. In this embodiment, therefore, the rotating moment is received at the portion having the smaller radius of curvature. The cylinder and the displacer are so contoured that the distance $\epsilon'$ between the cylinder inner wall face and the displacer outer wall face in the section (as indicated by angles $\alpha$ and $\beta$) for the sliding contact by the rotating moment of the displacer is made smaller than the distance $\epsilon$ of the remaining sections. Here, the distance $\epsilon'$ is expressed to satisfy the following relations, for example, when the aforementioned clearance of the shaft drive system is considered and when the distance $\epsilon$ indicates the shaft eccentricity:

$$\epsilon>\epsilon'\geqq(\epsilon-(C1+C2)) \qquad \text{(Equation 1).}$$

On the other hand, the magnitudes of the angles $\alpha$ and $\beta$ of the sliding contact sections are set to or are more than the angle (e.g., 120 degrees because the three working chambers are formed, as shown) of the phase difference of the compression stroke of the individual working chambers so that a smooth contact may be realized no matter what position of rotational angle the drive shaft might be located at. The sliding contact section of the distance $\epsilon'$ and the non-sliding contact section of the distance $\epsilon$ are connected through an arc of a radius r, as illustrated in an enlarged scale in FIGS. 8(*a*) and 8(*b*). Here, the correction of the contour (i.e., the correction $\delta=\epsilon-\epsilon'$) is executed only on the side of the cylinder 4.

Figure 9A:
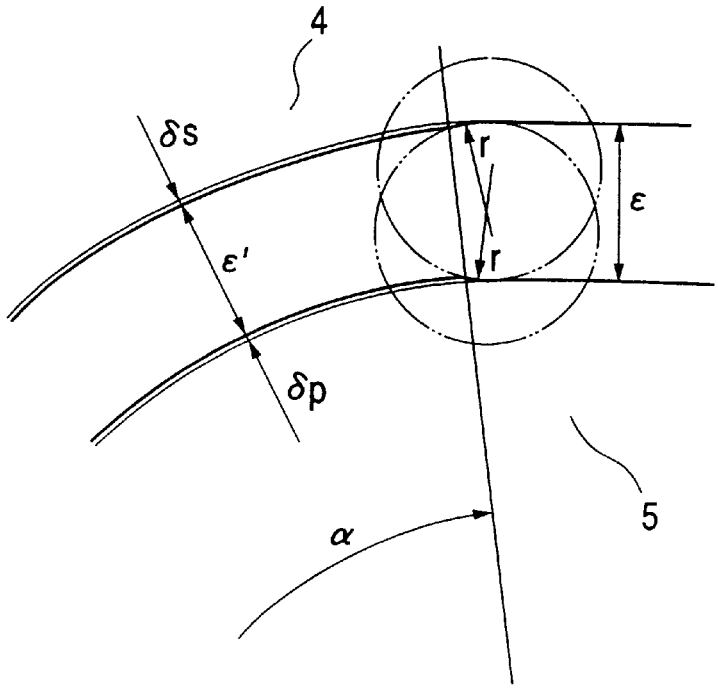
FIGS. 9(*a*) and 9(*b*) are enlarged views of essential portions (i.e., the portion A and the portion B) of FIG. 7 according to another embodiment of the invention.
Figure 9B:
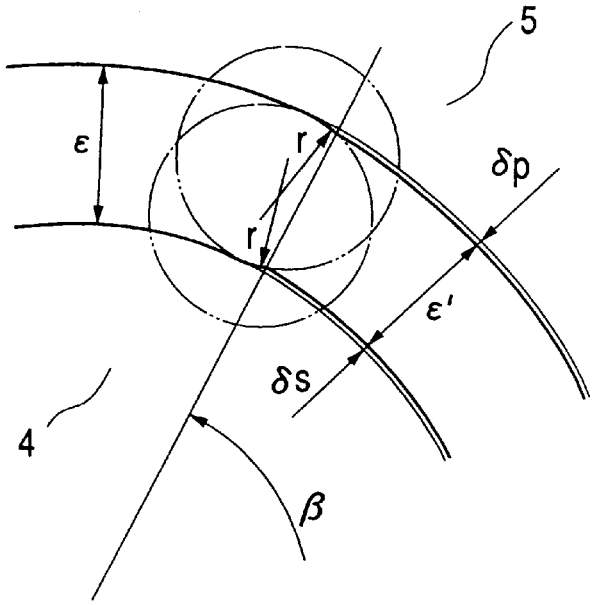

By adopting this contour, the play in the rotational direction of the displacer itself with the cylinder 4 and the displacer 5 meshing with each other is so small that the radial gap is not enlarged by the clearance of the shaft drive system and the rotating moment acting on the displacer. Since no contact exists other than at the section to be brought into sliding contact by the rotating moment acting upon the displacer, moreover, there does not arise the problem in which the reliability is lowered by an the excessive load acting upon the drive shaft. As a result, the radial gap between the cylinder and the displacer can be kept at the optimum value to provide an gyration type fluid machine capable of improved performance and a the reliability. Here, the correction $\delta$ of the contour is kept at constant value, but could be made variable depending upon the location of the sliding contact section by considering the bearing characteristics. In FIGS. 8(*a*) and 8(*b*), on the other hand, the contour is corrected only on the side of the cylinder 4. As shown in an enlarged scale in FIG. 9(*a*) and FIG. 9(*b*) FIG. 9, however, the correction of the contour can be executed for both the cylinder 4 (e.g., a correction $\delta$ s) and the displacer 5 (e.g., a correction $\delta$p). The correction of the contour at this time is exemplified by $\delta s=\delta p=\delta/2$.

Figure 10:
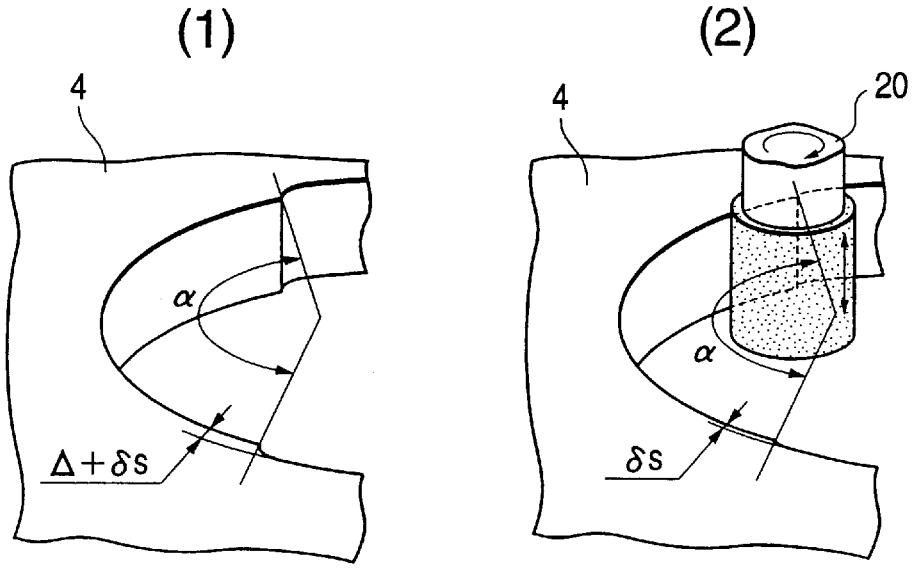
FIGS. 10(1) and 10(2) are working diagrams of an essential portion of the cylinder according to the embodiment of the invention.

In the embodiments thus far described, the sliding contact section between the cylinder and the displacer is restricted to a portion of the contour while leaving the remaining portion out of contact, so that the machining finish of the contour can be restricted to the sliding contact section thereby to lower the cost of manufacture drastically. FIGS. 10(1) and 10(2) illustrate this machining operation. FIG. 10(1) shows the shape of a portion of a raw material member (or cylinder). The raw material is a sintered metal, such as iron and is precisely molded and shaped to leave a finishing allowance $\Delta$ at the sliding contact section (of the angle $\alpha$). As shown in FIG. 10(2), therefore, the machining finish process with a grinding tool 20 or the like may be limited to that sliding contact section so that the working time period can be drastically shortened, as compared with the case in which the contour is machined all over its periphery, thereby to lower the cost.

Figure 11:
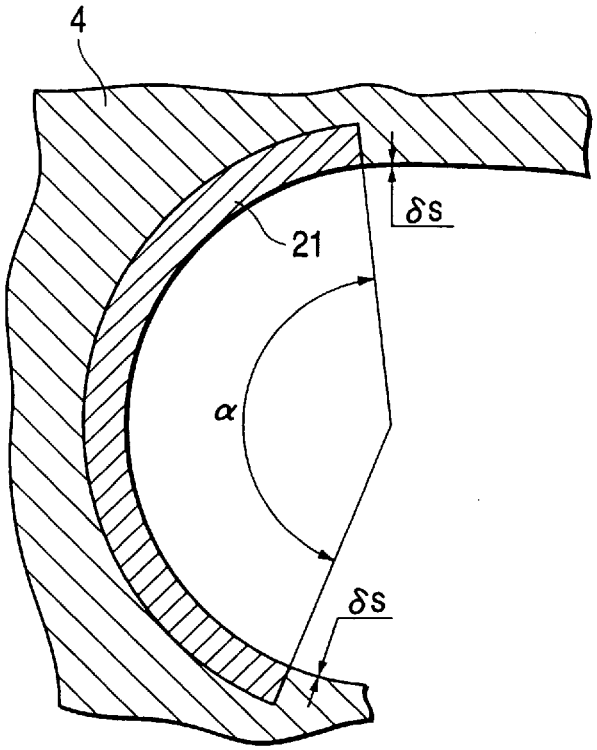
FIG. 11 is an enlarged section of an essential portion of a cylinder according to another embodiment of the invention.

FIG. 11 is an enlarged section of an essential portion of a cylinder according to another embodiment of the invention. Although the cylinder and the displacer are made of the same material in the embodiments thus far described, the invention should not be limited thereto since they could be made of two or more kinds of composite materials. In FIG. 11, numeral 21 designates an insert made of a wear resisting material which is fitted in the sliding contact section (of the angle $\alpha$) of the cylinder 4, and the contour of the $\delta$s is corrected. FIG. 11 presents the cylinder side, but the displacer side can also be likewise constructed. By this composite structure, it is possible to improve the reliability by reducing the wear on the cylinder and the displacer. Here, similar effects could also be achieved by making the material surface of the sliding contact section of the cylinder and the displacer formed of a single material harder than the remaining section. This structure is also encompassed by the invention.

Figure 12:
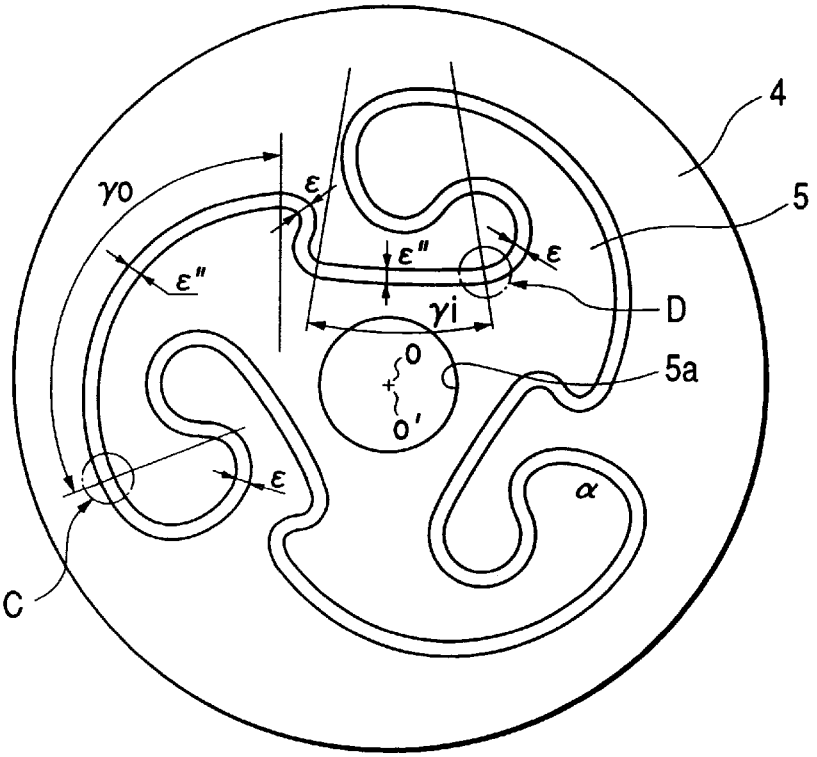
FIG. 12 is a top plan view of a cylinder and a displacer of a gyrating type fluid machine according to still another embodiment of the invention.
Figure 13C:
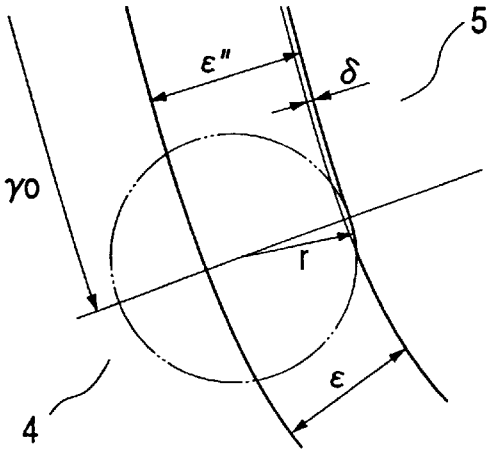
FIGS. 13(*c*) and 13(*d*) are enlarged diagrams (i.e., portion C and portion D) of FIG. 12.
Figure 13D:
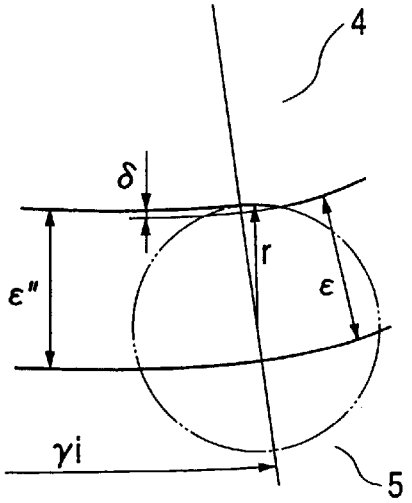

FIG. 12 is a top plan view showing the contour of the cylinder and the displacer according to still another embodiment of the invention, and an enlarged diagram showing portion C of FIG. 12 is shown in FIG. 13(*c*) while and an enlarged diagram showing portion D is shown in FIG. 13(*d*). In FIG. 12, the center o' of the cylinder 4 and the center o of the displacer 5 are overlapped as in FIG. 7. As has also been described with reference to FIG. 6, another method for reducing the enlargement of the radial gaps (δc, δd and δf) by the clearance of the shaft drive system and the rotating moment acting upon the displacer is considered to enlarge the gyrating radius of the displacer by increasing the eccentricity of the drive shaft from ϵ to ϵ". If the eccentricity of the drive shaft is merely enlarged in this case, the displacer comes at its outer peripheral contour (or the seal point) into contact with the cylinder so that an extremely excessive load (or the reaction at the contact portion) is liable to act upon the drive shaft, thereby to cause a problem leading to a lowered reliability, such as seizure of the shaft. By setting the normal distance between the cylinder 4 and the displacer 5 in the peripheral contour (i.e., the section as indicated by angles γo and γi, although only one working chamber is representatively shown, and likewise in the remaining two working chambers) where that contact problem is liable to occur, as shown in FIG. 12, to the larger value ϵ" than the remaining section ϵ in conformity with the shaft eccentricity, however, the problem of the lowered reliability can be solved to reduce the radial gap. Here, the relations between the distances ϵ" and ϵ are made to satisfy the following equation, if the value ϵ" is the shaft eccentricity while considering the aforementioned clearance of the shaft drive system:

$$\epsilon'' > \epsilon \geqq (\epsilon'' - (C1 + C2)) \quad \text{(Equation 2).}$$

Here, the angles γo and γi of the contour correcting section are expressed by the apex angle of a single arc, when the contour is a single one, and by the sum of the apex angles of multiple arcs when the contour is composed of multiple arcs. The section of the normal distance ϵ" and the section of the normal distance ϵ are connected through an arc of the radius r, as shown in an enlarged scale in FIGS. 13(*c*) and 13(*d*). Here, the correction of the contour (i.e., the correction $\delta = \epsilon'' - \epsilon$) is executed only on the side of the displacer 5 for the section of the angle γo and only on the side of the cylinder 4 for the section of the angle γi while anticipating the subsequent working, but the invention should not be limited thereto. By adopting this contour, the contact problem in the peripheral contour of the cylinder 4 and the displacer 5 can be solved to improve the reliability, and the radial gap can also be reduced to provide a gyration type fluid machine capable of improved performance.

Although the invention has been described in connection with a high-pressure type compressor, it should not be limited thereto, but could likewise be applied for similar effects to a low-pressure type compressor in which the pressure in the hermetic casing is a suction pressure. Although the invention has been exemplified by the case in which the cylinder 4 and the displacer 5 are contoured to form three working chambers, on the other hand, it could be expanded to the case in which the number of working chambers is 3 to N (the value of which is practically limited by an upper limit of 8 to 10). Moreover, the contour of the compression element should not be limited to those of the embodiments, but the invention could also be applied to a general gyration type fluid machine which includes: a cylinder having an inner wall composed of continuous curves in its sectional shape; and a displacer having an outer wall facing the inner wall of the cylinder for forming, when gyrated, a plurality of spaces between the inner wall and the outer wall, so that the working fluid is conveyed by the cylinder and the displacer.

Here, the displacement type fluid machine according to the invention can be applied to a compressor for an air conditioning system, which makes use of a heat pump cycle for the cooling and heating operations. A displacement type compressor 30 operates, as illustrated in the operation principle diagram of FIG. 3, so that the working fluid (e.g., refrigerant HCFC22, R407C or R410A) is compressed between the cylinder 4 and the displacer 5 by starting the compressor.

In the case of a cooling operation, the compressed working gas at a high temperature and under a high pressure flows from the discharge pipe 16 through a four-way valve into an outdoor heat exchanger in which it liberates its heat and is liquefied with the blowing action of the outdoor fan, after which is throttled by an expansion valve so that it is adiabatically expanded to a low temperature and a low pressure. This expanded working fluid is caused to absorb the heat in the room by an indoor heat exchanger and is gasified and sucked via the suction pipe 15 into the displacement type compressor 30.

In the case of a heating operation, on the other hand, the refrigerant is delivered in an opposite direction to that of the cooling operation by switching the four-way valve, and the compressed high-temperature and high-pressure working gas flows from the discharge pipe 16 through the four-way valve into the indoor heat exchanger so that it liberates its heat and is liquefied by the blowing action of the indoor fan. The working fluid is then throttled by the expansion valve so that it is adiabatically expanded to a low temperature and a low pressure. The expanded working fluid is caused to absorb the heat from the atmosphere by the outdoor heat exchanger and is gasified. After this, the working gas is sucked through the suction pipe 15 into the displacement type compressor 30.

On the other hand, the displacement type compressor of the invention can also be applied to a cycle especially for refrigerating (or cooling) operation. In this cycle, by starting the displacement type compressor 30, the working fluid is compressed between the cylinder 4 and the displacer 5, and the compressed high-temperature and high-pressure working gas flows from the discharge pipe 16 to a condenser, in which it liberates its heat and is liquefied by the blowing action of the fan. The working fluid is throttled by the expansion valve so that it is adiabatically expanded to a low temperature and a low pressure. The expanded working fluid absorbs the heat and is gasified in an evaporator. After this, the working gas is sucked through the suction pipe 15 into the displacement type compressor 30.

Since the displacement type compressor according to the invention is mounted, it is possible to provide a refrigerating/air-conditioning system which has an excellent energy efficiency and which has a high reliability and a low vibration/noise. Here, the displacement type compressor 30 has been exemplified by high-pressure type device, but the invention could likewise function for the similar effects even with a low-pressure type device.

The embodiments thus far described have been described by reference to a displacement type fluid machine in the form of a compressor, but the invention can be additionally applied to a pump, an expander or a power machine. As the motion mode of the invention, on the other hand, one (or the cylinder) is fixed, whereas the other (or the displacer) does not rotate in a substantially constant gyrating radius, but orbits. However, the invention could also be applied as well to a rotation type gyration type fluid machine in which the motion mode is relatively equivalent to the aforementioned motion.

According to the invention, as has been described hereinbefore, the contour of the cylinder is composed of a offset curve of the contour of the displacer, and the offset is changed for certain location. As a result, it is possible to set such a radial gap of the displacer sliding portion as to satisfy requirements for performance and the reliability, and to reduce the internal leakage of the working fluid thereby to provide a displacement type fluid machine of high performance.

What is claimed is:

1. A displacement type fluid machine in which one space is formed by the inner wall face of a cylinder and the outer wall face of a displacer when the center of said displacer is located at the center of rotation of a rotating shaft, and in which a plurality of spaces are formed when a positional relationship between said displacer and said cylinder is located at the position of gyration, wherein when the center of said displacer is located at the center of rotation of said rotating shaft, the gap between the inner wall face of said cylinder and the outer wall face of said displacer is made alternately wide and narrow.

2. A displacement type fluid machine in which a displacer and a cylinder are arranged between end plates, in which one space is formed by the inner wall face of said cylinder and the outer wall face of said displacer when the center of said displacer is located at the center of rotation of a rotating shaft, and in which a plurality of spaces are formed when a positional relationship between said displacer and said cylinder is located at the position of gyration, wherein said displacer is caused by a rotating moment in a fixed direction to slide into contact with said cylinder in a predetermined section, and wherein said cylinder and said displacer are so contoured that the distance in the sliding contact section between the inner wall face of said cylinder and the outer wall face of said displacer is smaller than that of sections other than the sliding contact section when the center of said displacer is located at the center of rotation of a rotating shaft.

3. A displacement type fluid machine according to claim 1 or 2, wherein at the time of working said cylinder inner wall face and said displacer outer wall face, said cylinder and said displacer are machine-finished only at the sliding contact section between the two.

4. A displacement type fluid machine according to claim 1 or 2, wherein the sliding contact section between said cylinder inner wall face and said displacer outer wall face has a higher material surface hardness than that of the remaining section.

5. A displacement type fluid machine according to claim 1 or 2, wherein the sliding contact section between said cylinder inner wall face and said displacer outer wall face is made of a material different from that of sections other than the sliding contact section.

* * * * *